United States Patent [19]

Pflieger

[11] Patent Number: 4,600,248

[45] Date of Patent: Jul. 15, 1986

[54] MODULAR DESK CONSTRUCTION

[75] Inventor: David C. Pflieger, Two Rivers, Wis.

[73] Assignee: Hamilton Industries, Two Rivers, Wis.

[21] Appl. No.: 603,645

[22] Filed: Apr. 25, 1984

[51] Int. Cl.[4] ..... A47B 41/02

[52] U.S. Cl. ..... 312/195

[58] Field of Search ..... 312/195; 248/297.2; 411/432, 427, 84, 85

[56] References Cited

U.S. PATENT DOCUMENTS

| | | | |
|---|---|---|---|
| 2,282,851 | 5/1942 | Burke | 411/967 |
| 2,809,726 | 10/1957 | Farquhar et al. | 411/427 |
| 2,915,351 | 12/1959 | Shinn | 312/195 |
| 2,987,362 | 6/1961 | Bernath | 312/257 |
| 3,259,165 | 7/1966 | Tobian et al. | 411/85 |
| 3,346,311 | 10/1967 | Bears | 312/195 |
| 3,847,489 | 11/1974 | Van Riper | 248/297.2 X |
| 3,857,622 | 12/1974 | Mohr | 312/257 |
| 3,920,298 | 11/1975 | Lopez | 312/195 |
| 4,050,752 | 9/1977 | Dykstra | 312/243 |
| 4,101,183 | 7/1978 | McManus | 312/195 |
| 4,176,889 | 12/1979 | Gartung | 312/195 |
| 4,382,642 | 5/1983 | Burdick | 312/194 |

FOREIGN PATENT DOCUMENTS

| | | | |
|---|---|---|---|
| 1310958 | 1/1962 | France | 312/195 |
| 2064305 | 6/1981 | United Kingdom | 248/297.2 |

*Primary Examiner*—William E. Lyddane
*Assistant Examiner*—Joseph Falk
*Attorney, Agent, or Firm*—Tilton, Fallon, Lungmus

[57] ABSTRACT

A desk having a planar top panel of generally rectangular outline, a leg or base structure for supporting that panel, at least one support track secured to the underside of the top panel and extending longitudinally therealong, and a modular storage or support unit, such as a drawer unit, movably suspended from the track and capable of being easily clamped in any selected position therealong in accordance with the needs and preferences of a user.

5 Claims, 6 Drawing Figures

MODULAR DESK CONSTRUCTION

BACKGROUND AND SUMMARY

Modular office furniture is already known in the art. Prior modular constructions permit the manufacturer, dealer, or other supplier to assemble a desk from a number of interchangable units, thereby reducing inventory problems while at the same time giving the supplier greater versatility in meeting user requirements. For example, a desk with a right-hand storage module can be assembled by the supplier simply by connecting such a module to a desk top supported by a pair of modular leg assemblies. However, such storage modules are not always interchangable; if at some later date the user should wish to convert the desk to left-hand storage, the purchase of an additional module might be required. Even if the modules are interchangable, the work involved in making the interchange may be substantial, necessitating the disassembly and reassembly of the desk structure. Furthermore, the choices for such reassembly are usually severely limited; for example, an interchangable drawer module may be fixed in either of two positions (i.e., right and left hand positions) without any possibility of variation from those positions.

Accordingly, it is an object of this invention to provide a modular desk construction in which the storage module, such as a drawer module, may be easily suspended from the top panel of the desk, may be shifted by the user (or supplier) into a right-hand position, left-hand position, or any selected position therebetween, and may be securely and easily (without tools) anchored or clamped in its selected position.

Briefly, the modular desk includes a generally rectangular top panel, a pair (preferably) of pedestal leg assemblies secured to the underside of the top panel adjacent its opposite ends, at least one suspension track secured to the underside of the top panel and extending horizontally between the leg assemblies, a storage or support module, and connecting means for slidably suspending the module from the track and for securely clamping it in any selected position along that track. Ideally, a pair of such tracks, mounted in spaced parallel relation, are provided.

Each track includes two side members with inwardly-turned horizontal flanges defining a horizontal channel, the flanges of each track having opposing longitudinal edges spaced apart to define an access slot into the channel. In a preferred embodiment, the side members of each track are generally vertical and are provided with outwardly-turned upper flanges secured to the underside of the top panel. The members of the track are metal (preferably steel) and the upper flanges are secured to the top panel at closely-spaced locations so that the tracks effectively reinforce the top panel of the desk as well as provide means for suspending the storage or support module from that panel.

The connecting means for slidably suspending the module from the tracks takes the form of a plurality of connectors. Each connector includes a clamping plate with a threaded central aperture and a screw member coupled to the clamping plate. The clamping plate is received within one of the channels of the track system and is slidably supported by the inwardly-turned lower flanges. The screw member has a finger-gripping portion, a threaded shank portion, and an enlarged collar portion disposed between the shank and gripping portions. Each screw member has its gripping and collar portions disposed within the compartment of the storage module with its threaded shank portion extending upwardly through an opening in the top wall of that module and through the slot leading into the channel of the track. The threaded shank portion is received by the rectangular clamping plate disposed within the channel. When the screw members are loosened, the module may be shifted along the tracks into any selected location. Thereafter, the screw members may be tightened to clamp the top wall of the module tightly against the flanges of the track.

Other features, objects, and advantages will be apparent from the specification and drawings.

THE DRAWINGS

DETAILED DESCRIPTION OF PREFERRED EMBODIMENT

Figure 1A:
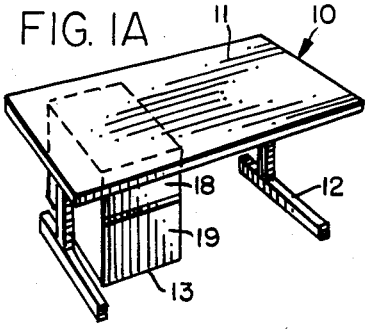
FIG. 1A is a perspective view of a modular desk construction illustrating a storage module in a left-hand position.

Referring to the drawings, the numeral 10 generally designates a modular desk having a planar top panel 11, a pair of pedestal leg assemblies 12 secured to the underside of the top panel at opposite ends thereof, and a storage module 13. The storage or support module is adapted to be suspended from the underside of the top panel and, in the embodiment illustrated, is provided with top, side, and bottom walls 14-16 defining a storage compartment 17. The storage module is also shown to have upper and lower drawers 18 and 19 slidably and removably received within compartment 17; however, it is to be understood that the storage module might instead be provided with one or more doors leading to compartment 17, or may even take the form of a doorless storage bin (with or without shelves) or some other suitable sulport or storage means. For purposes of this invention, the important features of the support or storage module is that it be suspended from the top panel as hereinafter described and that it include at least a top wall 14 permitting such suspension.

Figure 2:
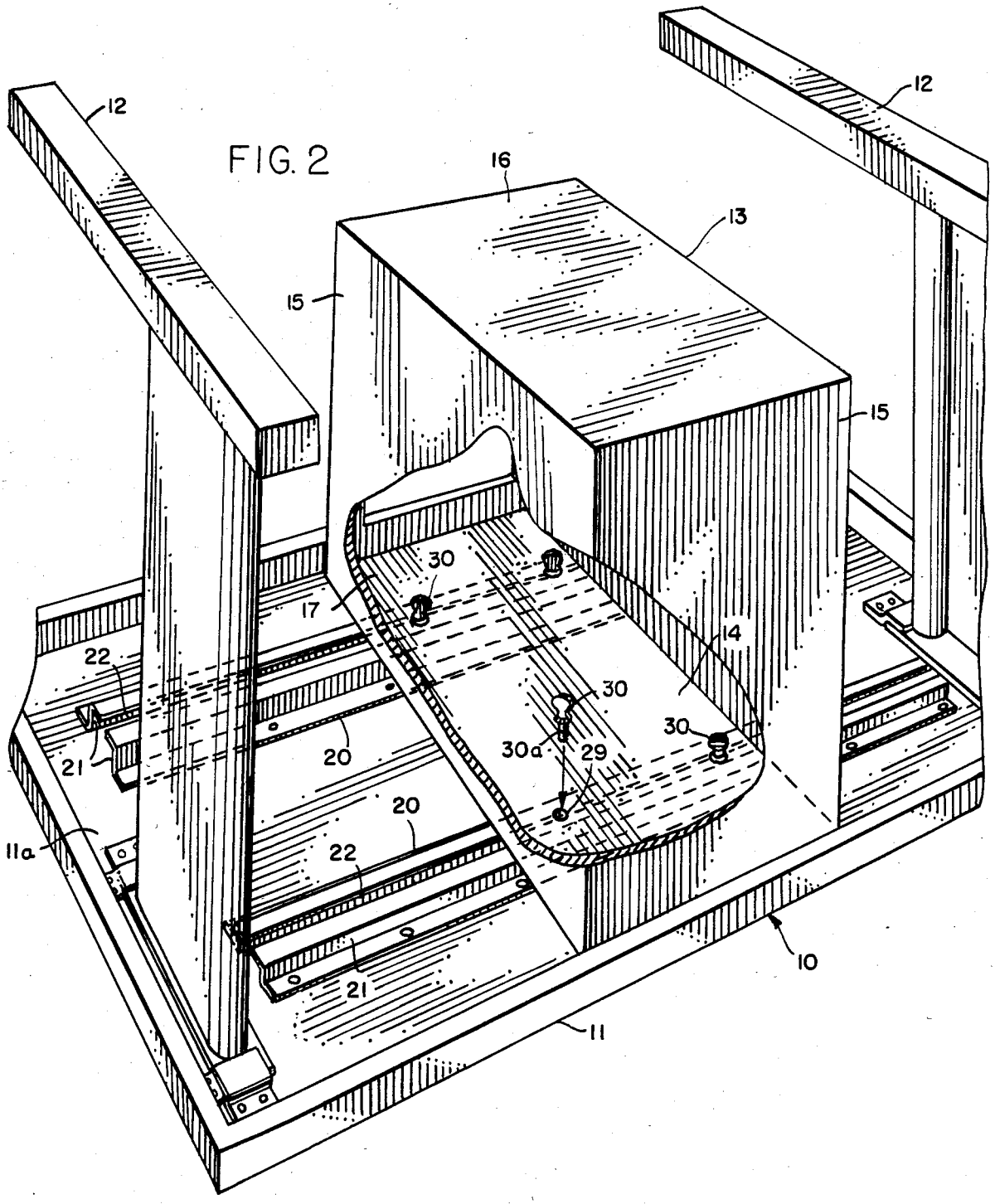
FIG. 2 is a fragmentary perspective view showing the modular desk in inverted condition.
Figure 3:
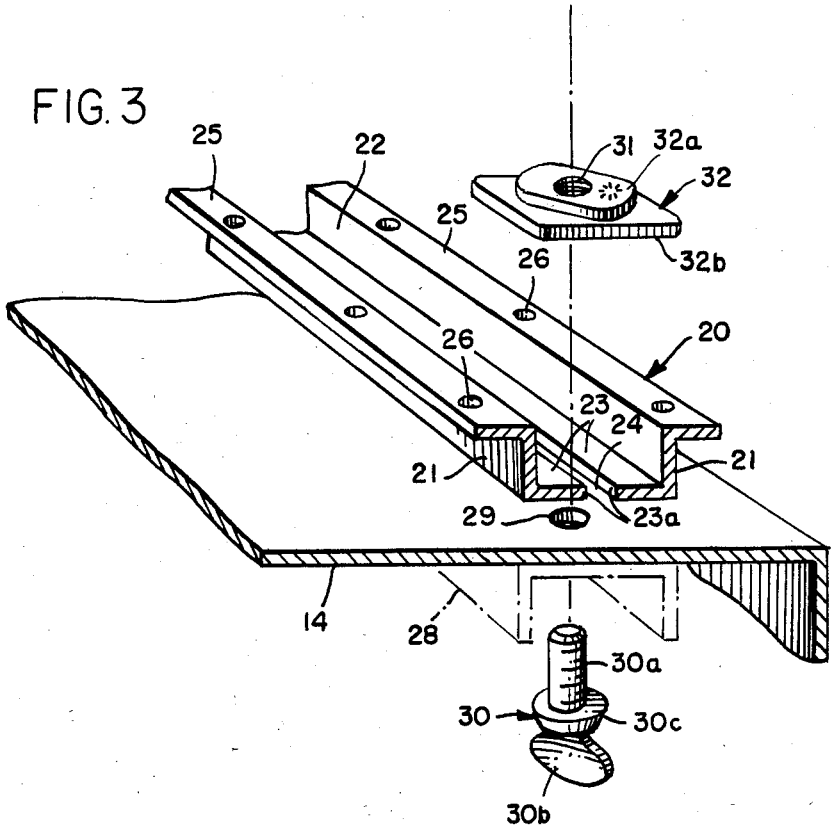
FIG. 3 is an exploded fragmentary perspective view showing the relationship between a storage module, the suspension track system, and the connecting elements.
Figure 4:
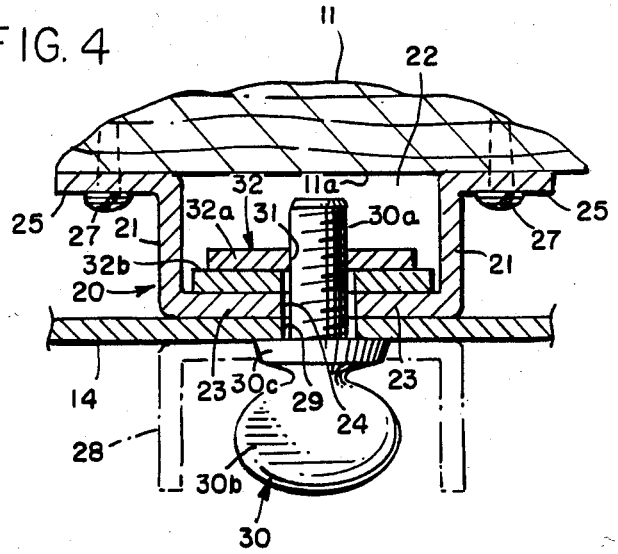
FIG. 4 is an enlarged sectional view illustrating the suspending and clamping means.

As shown most clearly in FIG. 2, a pair of track assemblies 20 are secured to the underside **11*a* of top panel 11, the track assemblies being disposed in spaced parallel relation and extending longitudinally along the underside of the elongated rectangular top from the area of one leg assembly 12 to the other. Each track is composed of a pair of generally Z-shaped bars or members. More specifically, each track has two horizontally-elongated side members 21 extending in spaced parallel relation and defining a channel 22 therebetween (FIGS. 3 and 4). At their lower ends, members 21 have inturned flanges 23 with opposing longitudinal edges 23*a* that are spaced apart to define an access slot 24 for channel 22. The vertical side members 21 also have upper flanges 25 which, in the illustrated embodiment, project laterally outwardly and are provided with openings 26 at closely-spaced intervals (preferably less than 12 inches apart) for receiving screws 27 that securely connect the track components to the underside of top panel 11**.

The top panel may be formed of any of a variety of materials although wood, wood products (such as veneered or laminated particleboard) and various polymeric or cellulosic laminates are commonly used. The flanged members 21 that define tracks 20 are preferably formed of steel or other rigid metal and, especially because of their configuration and secure attachment to the underside of the top panel 11, the track assemblies may perform an important secondary function in reinforcing or bracing the top panel of the desk.

The top wall 14 of storage or support module 13 may optionally be braced or reinforced by U-shaped (inverted) channel members 28 as shown in phantom in FIGS. 3 and 4. Such bracing by channel members 28 may be omitted if the top wall 14 is of sufficient thickness and strength. In any event, a plurality of openings 29 are provided through top wall 14 and through any reinforcing members 28 secured to the underside of that top wall. Where two trark assemblies 20 are provided, there should be at least three such openings, two aligned with the slot 24 of one track assembly 20 and the other opening (or openings) aligned with the slot 24 of the other parallel track assembly. Screw members or connectors, preferably in the form of thumbscrews 30, extend upwardly through openings 29 and slots 24 into channels 22 where the shank portions 30*a* of the thumbscrews are threadedly received within threaded apertures 31 of rectangular clamping plates 32 disposed within the channels.

Clamping plates 32 are shown to be generally square in outline (FIG. 3) and may be provided with upper and lower sections 32*a* and 32*b*, respectively, welded or otherwise rigidly and permanently joined together. The lower section 32*b* defines the outline of the composite plate and its opening is preferably unthreaded. The upper section 32*a* constitutes a reinforcement for the lower plate and also provides the threaded opening (in direct register with the opening in lower section 32*b*) that engages the threaded shank portion 30*a* of thumbscrew 30.

Each thumbscrew 30 also has a gripping portion 30*b* and an enlarged collar or shoulder portion 30*c*, both located within the compartment 17 of storage module 13. While the finger-gripping portion 30*b* is shown to be flattened, it will be understood that other forms of knobs or handles might be provided. It is believed important that in any event the portion 30*b* should be capable of being gripped and rotated manually without the use of tools.

Figure 1B:
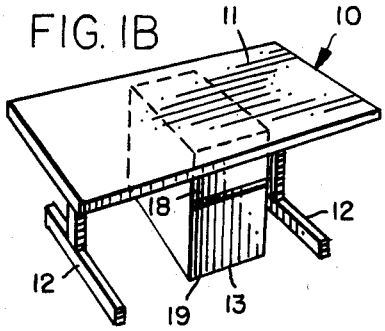
FIG. 1B is a perspective view similar to FIG. 1A but showing the storage module in an intermediate position.
Figure 1C:
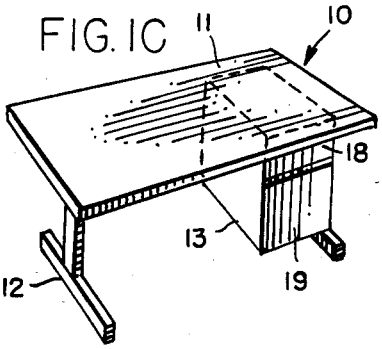
FIG. 1C is a perspective view similar to FIGS. 1A and 1B but showing the module in a right-hand position.

FIG. 2 illustrates the components of the modular desk in inverted condition. Such inversion is helpful during initial assembly although not absolutely essential. Once the parts have been assembled to the extent that the thumbscrew connectors 30 extend through the top wall of the storage module into the threaded clamping plates 32 carried within channels 22, the desk may be reverted and the storage module may be shifted into any selected position along the length of track assemblies 30. Should a left-hand configuration be desired, the storage module is shifted into the position depicted in FIG. 1A; should a right-hand position be preferred, the module is slid into the position of FIG. 1C. Any selected position between those extremes, such as the intermediate position of FIG. 1B, might also be selected. Thereafter, the thumbscrew connectors are simply tightened to clamp the module in its selected position. It will be understood that the tightening (or subsequent loosening) of the thumbscrews is performed by simply reaching into the interior of the module when its drawers are removed (or when its door is open); hence, no disassembly of the module's casing is necessary to gain access to the clamping elements.

In FIG. 2, one of the thumbscrews is shown unthreaded from its clamping plate simply for clarity of illustration. Ordinarily, during assembly of module 13 ard top panel 11, it is easier if the thumbscrews are first inserted through openings 29 in top wall 14 and are then loosely threaded onto clamping plates 32. Thereafter, the clamping plates are inserted into channels 22 of the tracks 20 from one end of top panel 11, the module is shifted into its desired position of adjustment, and the thumbscrews are tightened to lock the module in position. To facilitate insertion of the clamping plates into the channels, leg assemblies 12 may be left unattached to the top panel until such insertion is completed.

While in the foregoing an embodiment of the invention has been disclosed in considerable detail for purposes of illustration, it will be understood by those skilled in the art that many of these details may be varied without departing from the spirit and scope of the invention.

I claim:

1. A modular desk comprising a generally rectangular top panel; leg means secured to the underside of said top panel for supporting the same upon a floor surface; at least one suspension track secured to the underside of said top panel between said leg means and extending longitudinally along said top; said track including a pair of side members with inwardly-turned horizontal flanges defining a generally horizontal channel; said flanges of said track having opposing longitudinal edges spaced apart to define an access slot into said channel; a storage or support module having a generally horizontal wall disposed beneath said top panel and having a width measured in the direction of said track substantially less than the length of said track between said leg means; and connecting means for slidably suspending said module from said track and for securely clamping it in any selected position therealong; said means comprising a plurality of connectors each including (a) a clamping plate with a threaded aperture received in said channel and slidably supported by said flanges and (b) a thumbscrew member having a finger gripping portion, a threaded shank portion, and an enlarged collar portion between said shank and finger gripping portions; each thumbscrew member having its finger gripping and collar portions disposed beneath said wall of said module and its shank portion extending upwardly through an opening in said wall of said module and through said slot of said track into said threaded aperture of one of said clamping plates; whereby, when said thumbscrew members are loosely threaded to said connectors said module is suspended from but may be shifted along said track, and when said thumbscrew members are tightened said wall of said module is securely clamped against the flanges of said track.

2. The modular desk of claim 1 in which each of said clamping plates is generally rectangular in outline.

3. A modular desk comprising a generally rectangular top panel, leg assemblies secured to the underside of said top panel adjacent opposite ends thereof; a pair of spaced parallel suspension tracks secured to the underside of said panel and extending horizontally between said leg assemblies; each track including a pair of generally vertical side members with inwardly turned horizontal flanges defining a generally horizontal channel; said flanges of each track having opposing longitudinal edges spaced apart to define an access slot into said channel; a storage or support module having a generally horizontal wall disposed beneath said top panel and having a width measured in the direction of said track substantially less than the distance between said leg assemblies; and connecting means for slidably suspending said module from said tracks and for securely clamping it in any selected position therealong; said means comprising a plurality of connectors each including (a) a clamping plate with a threaded aperture received in one of said channels and slidably supported by said flanges and (b) a thumbscrew member having a gripping portion, a threaded shank portion, and an enlarged collar portion between said shank and gripping portions; each thumbscrew member having its gripping and collar portions disposed beneath said wall of said module and its shank portion extending upwardly through an opening in said wall of said module and through said slot of said track into said threaded aperture of one of said clamping plates; whereby, when said thumbscrew members are loosely threaded to said connectors said module is suspended from but may be shifted along said tracks, and when said thumbscrew members are tightened said wall of said module is securely clamped against the flanges of said tracks.

4. The modular desk of claim 3 in which each of said clamping plates is generally rectangular in outline.

5. The modular desk of claim 4 in which each of said clamping plates includes a lower section having an unthreaded opening larger than said shank portion of said screw member and an upper section providing said threaded aperture in alignment with said unthreaded opening of said lower section; said upper and lower sections being permanently joined together.

* * * * *